US005719542A

United States Patent [19]

Park et al.

[11] Patent Number: 5,719,542

[45] Date of Patent: Feb. 17, 1998

[54] CONVERGENCE YOKE FOR IMPROVING FOCUS CHARACTERISTICS

[75] Inventors: Jinhong Park; Yoonseok Cha; Doohyun Lee, all of Kyunggi-do, Rep. of Korea

[73] Assignee: Samsung Display Devices Co., Ltd., Kyunggi-do, Rep. of Korea

[21] Appl. No.: 213,905

[22] Filed: Mar. 14, 1994

[30] Foreign Application Priority Data

Sep. 23, 1993 [KR] Rep. of Korea ..... 1993-19501

[51] Int. Cl.[6] ..... H01J 27/70; H01J 29/76

[52] U.S. Cl. ..... 335/213; 313/440

[58] Field of Search ..... 335/210, 213; 313/412, 428, 440

[56] References Cited

U.S. PATENT DOCUMENTS 4,961,021 10/1990 Oguro et al. ..... 313/412

*Primary Examiner*—Michael L. Gellner

*Assistant Examiner*—Raymond Barrera

*Attorney, Agent, or Firm*—Christie, Parker & Hale, LLP

[57] ABSTRACT

The present invention discloses a convergence yoke for improving focus characteristic. It comprises vertical correcting coils and horizontal correcting coils coils connected to a vertical deflection signal line and producing a barrel-shaped deflection field more enfeebled in magnetic shape without the change of magnetic force or equalizing a correction field without the change of magnetic force to improve focus characteristic of electron beams; and a core for making the vertical correcting coils and horizontal correcting coils produce an enfeebled barrel-shaped deflection field. Besides, this invention corrects coma aberration by compensating the barrel-shaped deflection field and the pincushion-shaped deflection field with each other to equalize the deflection fields without the change of magnetic force.

6 Claims, 5 Drawing Sheets

CONVERGENCE YOKE FOR IMPROVING FOCUS CHARACTERISTICS

FIELD OF THE INVENTION (1) Background of the Invention

This invention relates to a convergence yoke for improving focus characteristics. More particularly, it relates to a convergence yoke for improving focus characteristics of electron beams and achieving a more distinct picture quality by countervailing a barrel-shaped deflection field by means of a pincushion-shaped deflection field, or by weakening a barrel-shaped deflection field produced from the convergence yoke to correct a coma aberration.

(2) Description of Related Art

A projection television (TV) is characterized as a front surface projection type projecting electron beams from the direction of a TV audience, and a rear surface projection type projecting electron beams from the opposite direction of a TV audience.

The projection television includes a screen and cathode ray tubes of three mono-electron guns, respectively, emanating different colors of red, green and blue. Each cathode ray tube of the mono-electron guns includes a deflection yoke for deflecting electron beams, a convergence yoke for adjusting a convergence of three electron beams on the screen, a color purity magnet (CPM) for adjusting a static convergence, a reflector projecting a light of a phosphor surface to the screen, and a lens. Generally, a convergence yoke is mounted behind a deflection yoke.

The projection television uses three cathode ray tubes of the mono-electron guns as mentioned above, and three electron beams transmitted from the electron guns are deflected by the deflection yoke. Simultaneously, by using optical instruments such as the reflector or lens, a monochromatic image of red, green and blue is projected on the screen to form a color image.

In this case, because of the distance between the screen and each cathode ray tube of the mono-electron guns and the difference of incidence angle, three electron beams do not converge to one point. However, even though the three electron beams are focused on a screen center, they are not focused on screen corners. Conventionally, the misconvergence may be corrected by controlling an input current of the convergence yoke, after having a look at a pattern of a misconvergence appearing in the screen.

The description of a conventional convergence yoke referring to the accompanying drawings is as follows.

FIG. 1 depicts the structure of the conventional convergence yoke.

The conventional convergence yoke comprises a circular core 10 having four poles 11 protruded in its inside circumference; vertical correcting coils LV11, LV12 serially connected to vertical deflection signal lines $V^+$, $V^-$ and wound respectively on the corresponding poles 11 of the core 10; and horizontal correcting coils LH11, LH12 serially connected to horizontal deflection signal lines $H^+$, $H^-$ and wound, respectively, on the corresponding poles 11 of the core 10.

The operation of this convergence yoke is described as follows.

If the vertical deflection signals $V^+$, $V^-$ and the horizontal deflection signals $H^+$, $H^-$ are simultaneously applied to the convergence yoke, a barrel-shaped deflection field is produced from the vertical correcting coils LV11, LV12 and the horizontal correcting coils LH11, LH12. The barrel-shaped deflection field is shown in FIG. 2, and for convenience' sake, only the horizontal deflection field produced from the horizontal correcting coils LH11, LH12 are depicted in FIG. 2.

A dynamic convergence correction is performed by the barrel-shaped deflection field generated from the vertical correcting coils LV11, LV12 and the horizontal correcting coils LH11, LH12 such that the orbit of the three electron beams is corrected and the coma error may be corrected.

However, the conventional convergence yoke has a disadvantage that focus characteristics of the three electron beams is deteriorates, whereas the orbit of the three electron beams may be corrected. In other words, even though the three electron beams can land exactly at corresponding phosphor dots on the fluorescent surface by the convergence yoke, the focus characteristics of these beams deteriorate, and an incidence angle with which the three electron beams land at corresponding phosphor dots on the fluorescent surface becomes larger on the screen corners. Accordingly, pixels are out of shape because of luminescence of the luminous phosphor, which results in low picture quality.

SUMMARY OF THE INVENTION

An object of this invention is to solve the above problems with a convergence yoke which ensures the improvement of focus characteristics, as well as in the correction of coma aberration by countervailing the barrel-shaped deflection field by means of the pincushion-shaped deflection field, or by weakening the barrel-shaped deflection field produced from the convergence yoke to equalize them without the change of magnetic force.

To achieve this object, a preferred embodiment of this invention provides a convergence yoke for improving focus characteristics. The convergence yoke comprises vertical correcting coils and horizontal correcting coils connected to a vertical deflection signal line and producing a barrel-shaped deflection field more enfeebled in magnetic shape without the change of magnetic force or equalizing a correction field without the change of magnetic force to improve focus characteristics of electron beams; and a core for making the vertical correcting coils and horizontal correcting coils produce an enfeebled barrel-shaped deflection field.

The other preferred embodiment of this invention provides a convergence yoke for improving focus characteristics comprising vertical correcting coils and horizontal correcting coils connected with vertical and horizontal deflection signal lines in series and equalizing a deflection field without the change of magnetic force to improve focus characteristics of electron beams, by compensating the barrel-shaped deflection field and the pincushion-shaped deflection field with each other, simultaneously with correcting coma aberration by producing a deflection field changed from a barrel-shaped deflection field to a pincushion-shaped deflection field in accordance with the tube axial direction of a cathod ray tube; and a core for making the vertical correcting coils and horizontal correcting coils produce an equalized deflection field.

BRIEF DESCRIPTION OF THE DRAWINGS

This invention can be more fully understood from the following detailed description when taken in conjunction with the accompanying drawings, wherein.

DETAILED DESCRIPTION OF PREFERRED EMBODIMENTS

Figure 4A:
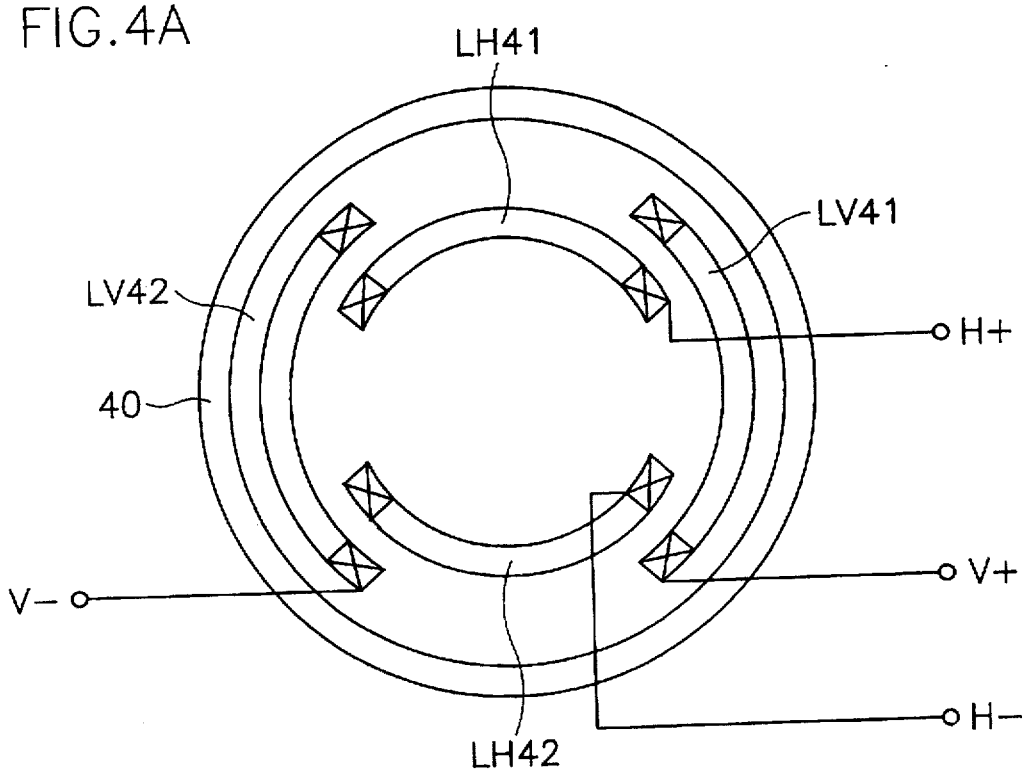
FIGS. 4A and 4B depict structures of each convergence yoke for improving focus characteristics in accordance with a first preferred embodiment of this invention.
Figure 4B:
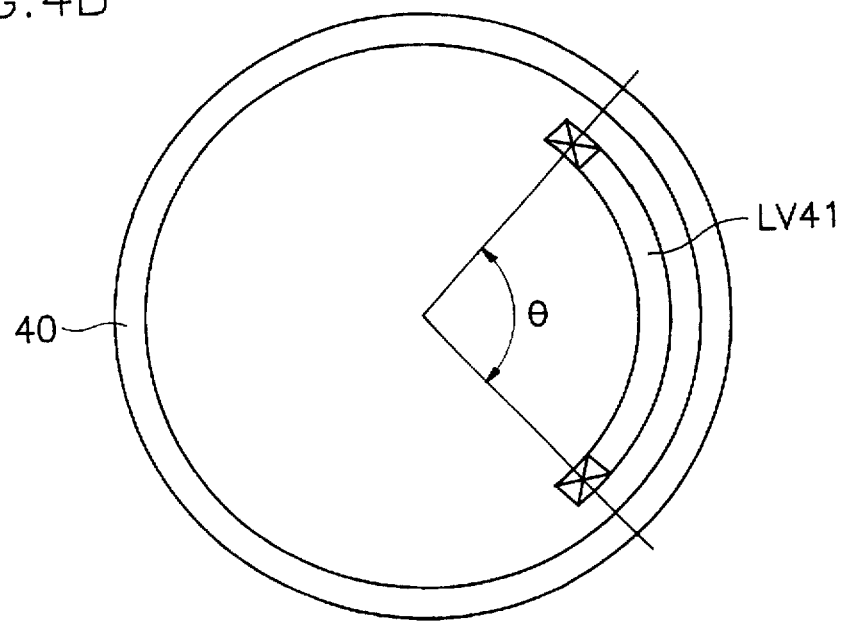

FIGS. 4A and 4B depict structures of a convergence yoke for improving focus characteristics in accordance with a first preferred embodiment of this invention.

A convergence yoke of the first preferred embodiment comprises a circular core 40; vertical correcting coils LV41, LV42 serially connected to vertical deflection signal lines $V^+$, $V^-$ and wound symmetrically in a vertically elliptical shape or rectangular shape against a central axis on the outer part of an inner circumference of the core 40; and horizontal correcting coils LH41, LH42 serially connected to horizontal deflection signal lines $H^+$, $H^-$ and wound symmetrically in a horizontally elliptical shape or rectangular shape against the central axis on the inner part of the inner circumference of the core 40.

The operation of the convergence yoke for improving focus characteristics in accordance with the first preferred embodiment is now described as follows.

If the vertical deflection signals $V^+$, $V^-$ and the horizontal deflection signals $H^+$, $H^-$ are simultaneously applied to the convergence yoke, a pincushion-shaped deflection field and a barrel-shaped deflection field are simultaneously produced from the vertical correcting coils LV41, LV42 and the horizontal correcting coils LH41, LH42 of the convergence yoke.

Figure 1:
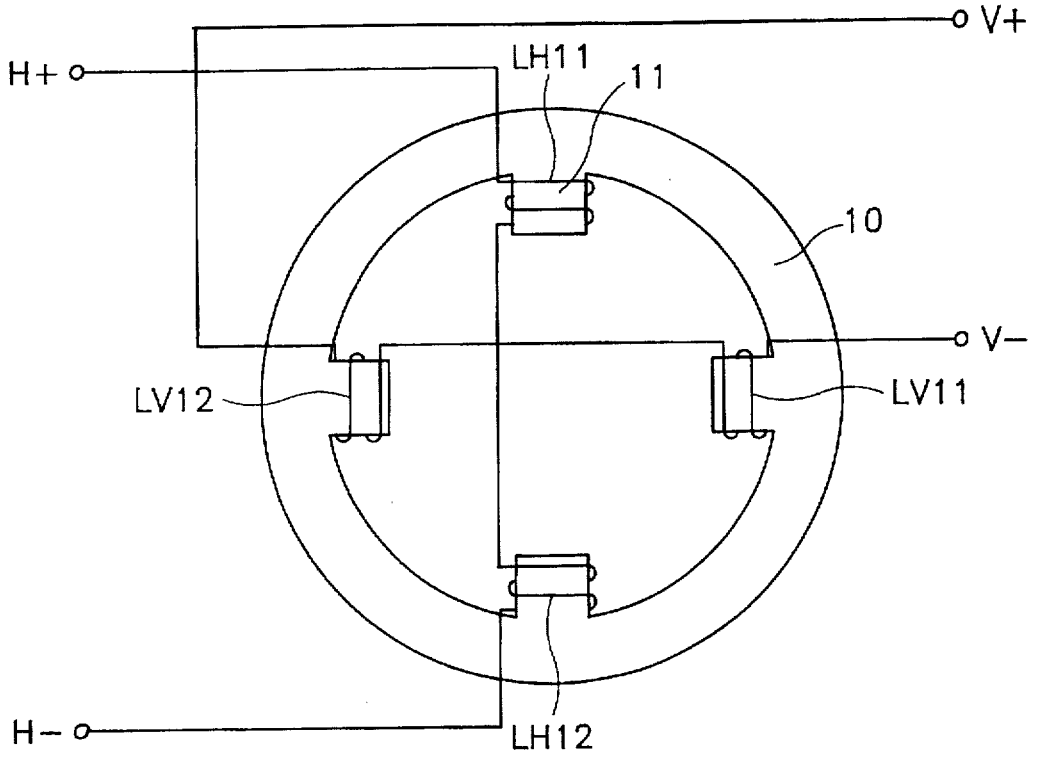
FIG. 1(Prior Art)
FIG. 1 depicts a structure of a conventional convergence yoke.
Figure 2:
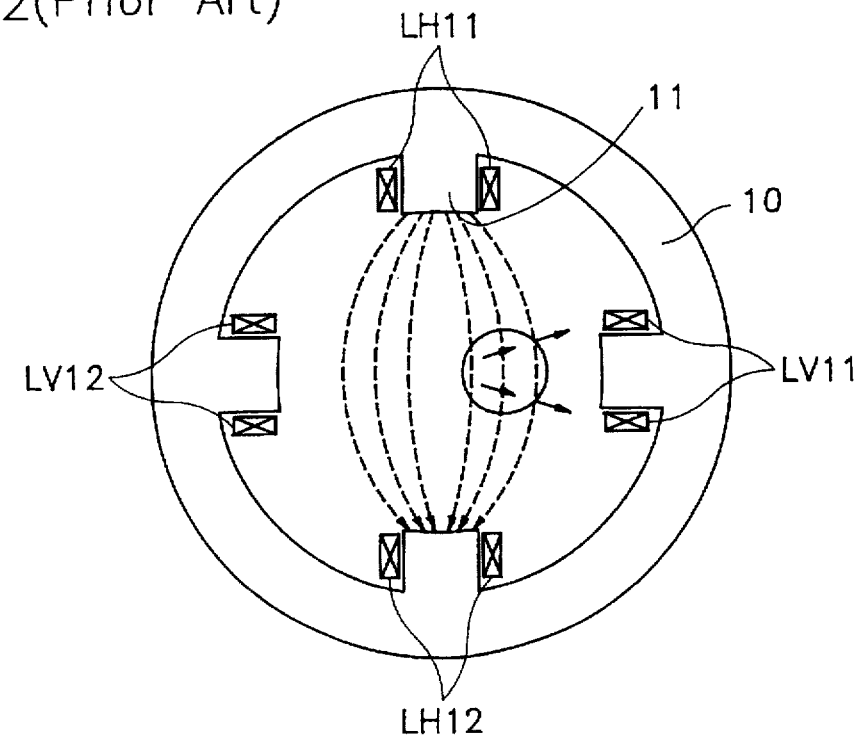
FIG. 2(Prior Art)
FIG. 2 is a distribution chart of a deflection field produced from the conventional convergence yoke.
Figure 3:
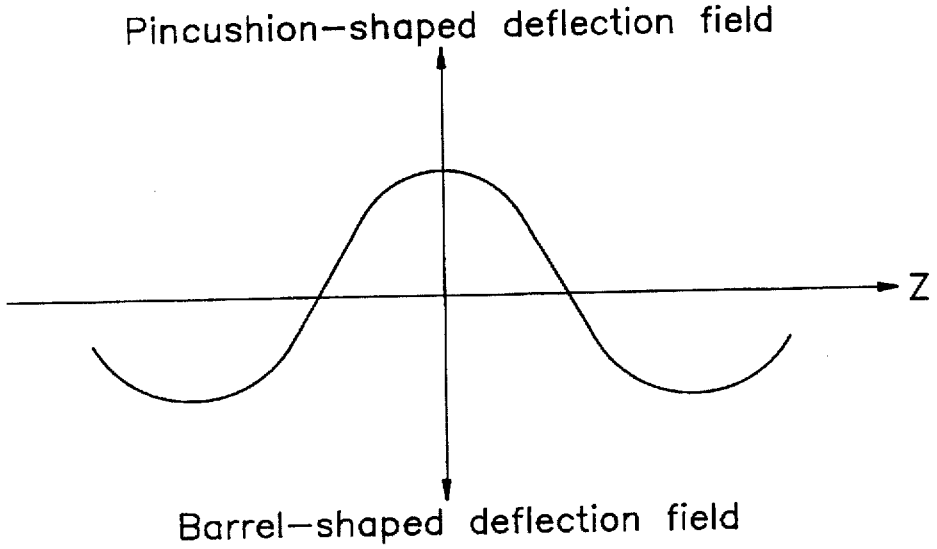
FIG. 3 shows a dispersion for a tube-axial length of deflection fields produced from the convergence yoke for improving focus characteristics in accordance with first, second, third and fourth preferred embodiments of this invention.

As the pincushion-shaped deflection field produced from the vertical correcting coils LV41, LV42 and the horizontal correcting coils LH41, LH42 of the convergence yoke is forwarded in the tube-axial direction of the cathode ray tube, it is changed to a barrel-shaped deflection field. The change in the shapes of the deflection fields in the tube-axial direction of the cathode ray tube are depicted in FIG. 3. FIG. 3 is a dispersion for the tube-axial length of deflection fields produced from the convergence yoke for improving focus characteristics in accordance with the preferred embodiment of this invention.

As mentioned above, the dynamic convergence correction of the electron beams is performed by the pincushion-shaped deflection field and the barrel-shaped deflection field produced from the vertical correcting coils LV41, LV42 and the horizontal correcting coils LH41, LH42. And, at the same time, focus characteristics may be improved by compensating the pincushion-shaped deflection field and the barrel-shaped deflection field with each other to equalize them, without the change of magnetic force. Accordingly, higher picture quality can be achieved.

Referring now to FIG. 4B, if a range the horizontal and vertical correcting coils occupy is designated as $\theta$ and is in $100° \leqq \theta \leqq 130°$ (a half of the coil), influence as to electron beams of the pin-shaped deflection field and the barrel-shaped deflection field is unified.

Figure 5:
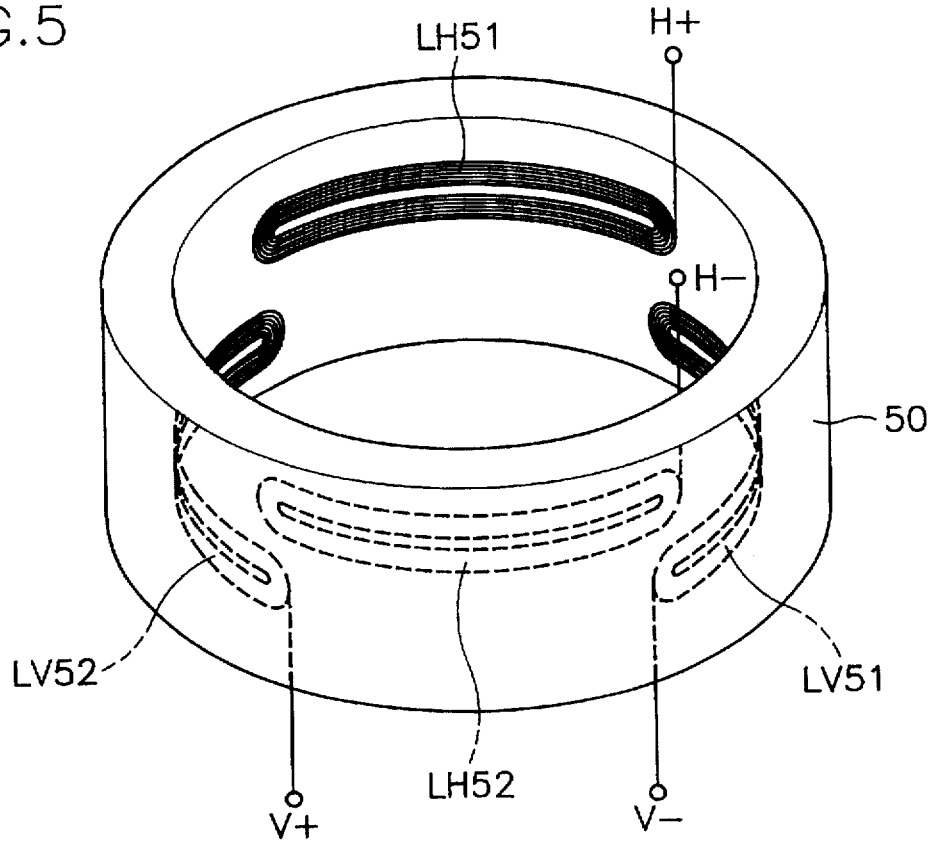
FIG. 5 depicts a structure of a convergence yoke for improving focus characteristics in accordance with a second preferred embodiment.

FIG. 5 depicts a structure of a convergence yoke for improving focus characteristics in accordance with a second preferred embodiment of this invention.

As shown in FIG. 5, a convergence yoke of the second preferred embodiment of this invention comprises a circular core 50; vertical correcting coils LV51, LV52 serially connected to vertical deflection signal lines $V^+$, $V^-$ and wound symmetrically in an elliptical or rectangular shape on the lower part of the inside circumference of the core 50 to be vertical to the central axis; and horizontal correcting coils LH51, LH52 serially connected to horizontal deflection signal lines $H^+$, $H^-$ and wound symmetrically in an elliptical shape on the upper part of the inside core 50 to be horizontal to the central axis.

The operation of the convergence yoke for improving focus characteristics in accordance with the second preferred embodiment is now described as follows.

If the vertical deflection signals $V^+$, $V^-$ and the horizontal deflection signals $H^+$, $H^-$ are simultaneously applied to the convergence yoke, a pincushion-shaped deflection field and a barrel-shaped deflection field are simultaneously produced from the vertical correcting coils LV51, LV52 and the horizontal correcting coils LH51, LH52 of the convergence yoke.

As the pincushion-shaped deflection yoke produced from the vertical correcting coils LV51, LV52 and the horizontal correcting coils LH51, LH52 of the convergence yoke is forwarded in the tube-axial direction of the cathode ray tube, it is changed to a barrel-shaped deflection field. The change in the shapes of the deflection fields in the tube-axial direction of the cathode ray tube are depicted in FIG. 3.

As mentioned above, the dynamic convergence correction of the electron beams is performed by the pincushion-shaped deflection field and the barrel-shaped deflection field produced from the vertical correcting coils LV61, LV62 and the horizontal correcting coils LH61, LH62. And, at the same time, focus characteristic may be improved by compensating the pincushion-shaped deflection field and the barrel-shaped deflection field with each other to equalize them without the change of magnetic force. Accordingly, higher picture quality can be achieved.

Figure 6:
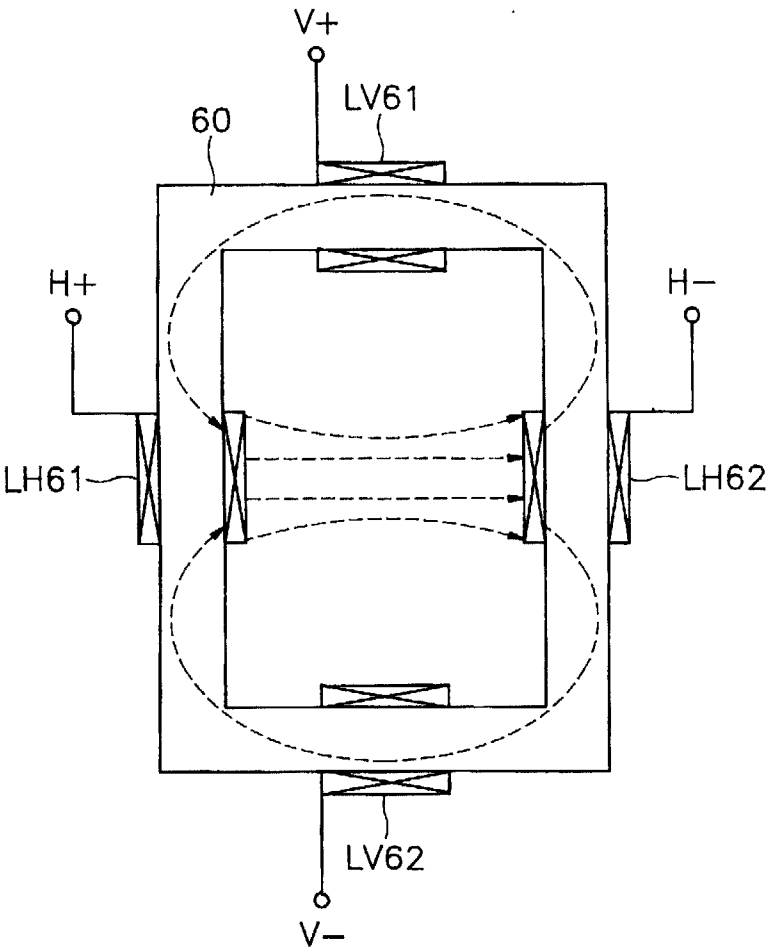
FIG. 6 depicts a structure of a convergence yoke for improving focus characteristics in accordance with a third preferred embodiment.

FIG. 6 depicts a structure of a convergence yoke for improving focus characteristics in accordance with a third preferred embodiment of this invention.

A convergence yoke of the third preferred embodiment comprises a rectangular core 60; vertical correcting coils LV61, LV62 serially connected to vertical deflection signal lines $V^+$, $V^-$ and wound symmetrically on the upper and lower sides of the core 60; and horizontal correcting coils LH61, LH62 serially. connected to horizontal deflection signal lines $H^+$, $H^-$ and wound symmetrically on the left and right sides of the core 60.

The operation of the convergence yoke in accordance with the third preferred embodiment of this invention is now described as follows.

If the vertical deflection signals $V^+$, $V^-$ and the horizontal deflection signals $H^+$, $H^-$ are simultaneously applied to the convergence yoke, a pincushion-shaped deflection field and a barrel-shaped deflection field are simultaneously produced from the vertical correcting coils LV61, LV62 and the horizontal correcting coils LH61, LH62 of the convergence yoke. The pincushion-shaped deflection field is shown in FIG. 6.

As the pincushion-shaped deflection yoke produced from the vertical correcting coils LV61, LV62 and the horizontal correcting coils LH61, LH62 of the convergence yoke is forwarded in the tube-axial direction of the cathode ray tube, it is changed to a barrel-shaped deflection field. The change in the shapes of the deflection fields in the tube-axial direction of the cathode ray tube are depicted in FIG. 3.

As mentioned above, the dynamic convergence correction of the electron beams is performed by the pincushion-shaped deflection field and the barrel-shaped deflection field produced from the vertical correcting coils LV61, LV62 and the horizontal correcting coils LH61, LH62. Simultaneously with it, focus characteristics may be improved by compensating the pincushion-shaped deflection field and the barrel-shaped deflection field with each other to equalize them without the change of magnetic force. Accordingly, higher picture quality can be achieved.

Figure 7:
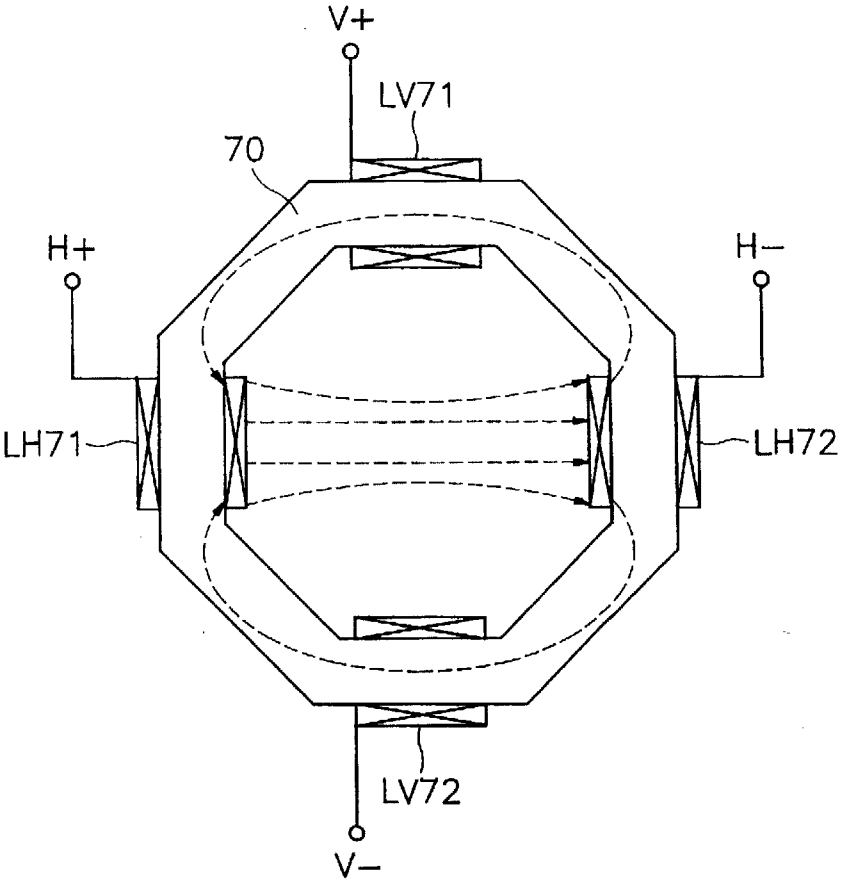
FIG. 7 depicts a structure of a convergence yoke for improving focus characteristics in accordance with a fourth preferred embodiment.

FIG. 7 depicts a structure of a convergence yoke for improving focus characteristic in accordance with a fourth preferred embodiment of this invention.

A convergence yoke of the fourth preferred embodiment comprises an octagonal core 70; vertical correcting coils LV71, LV72 serially connected to vertical deflection signal lines $V^+$, $V^-$ and wound symmetrically on the lower and upper sides of the core. 70; and horizontal correcting coils LH71, LH72 serially connected to horizontal deflection signal lines $H^+$, $H^-$ and wound symmetrically on the left and right sides of the core 70.

The operation of the convergence yoke in accordance with the fourth preferred embodiment of this invention is now described as follows. If the vertical deflection signals $V^+$, $V^-$ and the horizontal deflection signals $H^+$, $H^-$ are simultaneously applied to the convergence yoke, a pincushion-shaped deflection field and a barrel-shaped deflection field are simultaneously produced from the vertical correcting coils LV71, LV72 and the horizontal correcting coils LH71, LH72 of the convergence yoke (FIG. 7).

As the pincushion-shaped deflection yoke produced from the vertical correcting coils LV71, LV72 and the horizontal correcting coils LH71, LH72 of the convergence yoke is forwarded in the tube-axial direction of the cathode ray tube, it is changed to a barrel-shaped deflection field. The change in the shapes of the deflection fields in the tube-axial direction of the cathode ray tube are depicted in FIG. 3.

As mentioned above, the dynamic convergence correction of the electron beams is performed by the pincushion-shaped deflection field and the barrel-shaped deflection field produced from the vertical correcting coils LV71, LV72 and the horizontal correcting coils LH71, LH72. Simultaneously with it, focus characteristics may be improved by compensating the pincushion-shaped deflection field and the barrel-shaped deflection field with each other to equalize them without the change of magnetic force. Accordingly, higher picture quality can be achieved.

Figure 9:
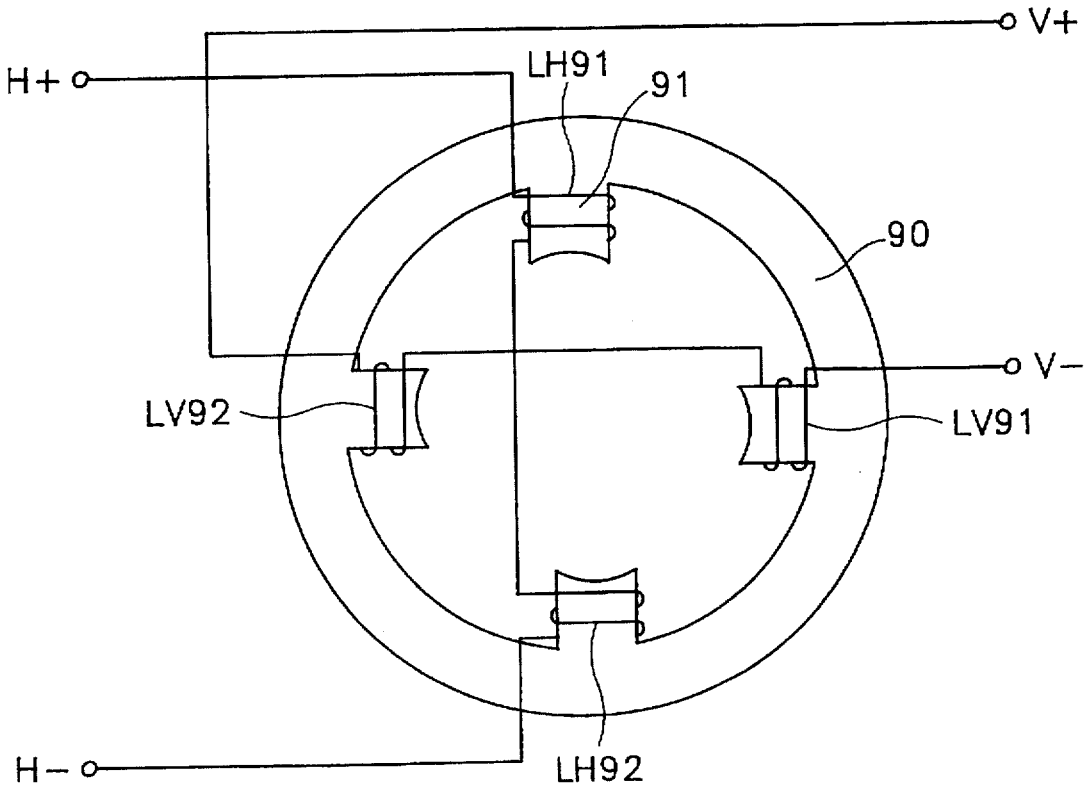
FIG. 9 depicts a structure of a convergence yoke for improving focus characteristics in accordance with the fifth preferred embodiment.

FIG. 9 depicts a structure of a convergence yoke for improving focus characteristics in accordance with a fifth preferred embodiment of this invention.

A convergence yoke of the fifth preferred embodiment of this invention comprises a cylindrical core 90 including four poles 91 having protruded parts whose centers are pressed in and formed on the inside circumference of the core 90 to confront each other obliquely; vertical correcting coils LV91, 92 serially connected to vertical deflection signal lines $V^+$, $V^-$ and wound respectively on the poles 91 of the core 90 opposite thereto; and horizontal correcting coils LH91, LH92 serially connected to horizontal deflection signal lines $H^+$, $H^-$ and wound respectively on the poles 91 of the core 90 opposite thereto.

The operation of the convergence yoke in accordance with the fifth preferred embodiment of this invention is now described as follows.

If the vertical deflection signals $V^+$, $V^-$ and the horizontal deflection signals $H^+$, $H^-$ are simultaneously applied to the convergence yoke, there is simultaneously produced a barrel-shaped deflection field enfeebled by the cores 91 of the core 90 including the pressed centers after having been produced from the vertical and horizontal correcting coils LV91, LV92 and LH91, LH92 of the convergence yoke.

Figure 8:
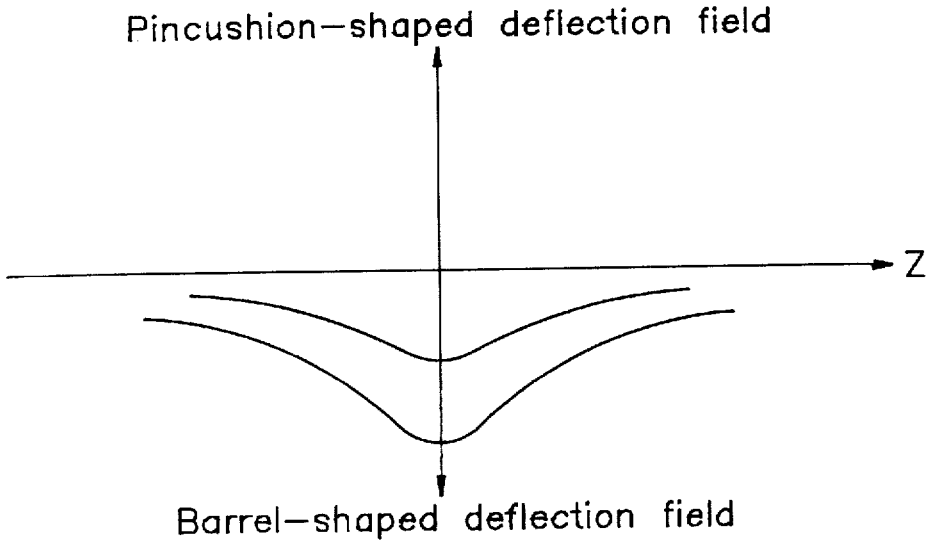
FIG. 8 shows a dispersion for a tube-axial length of deflection fields produced from the convergence yoke for improving focus characteristics in accordance with a fifth preferred embodiment of this invention.

FIG. 8 shows the transition from the feeble barrel-shaped deflection field produced from the vertical correcting coils LV91, LV92 and the horizontal correcting coils LH91, LH92 to the more feeble barrel-shaped deflection field in accordance with the tube-axial direction.

As mentioned above, the dynamic convergence correction of the electron beams is performed by the feeble barrel-shaped deflection field produced from the vertical correcting coils LV91, LV92 and the horizontal correcting coils LH91, LH92, and, at the same time, focus characteristic may be improved by equalizing the deflection fields with each other without the change of magnetic force. Accordingly, higher picture quality can be achieved.

The present invention provides a convergence yoke which ensures the improvement of focus characteristics, simultaneously with the correction of coma aberration by countervailing the barrel-shaped deflection field by means of the pincushion-shaped deflection field, or by weakening the barrel-shaped deflection field produced from the convergence yoke to equalize them without the change of magnetic force.

While this invention has been described in connection with what is presently considered to be the most practical and preferred embodiments, it is to be understood that the invention is not limited to the disclosed embodiments, but, on the contrary, it is intended to cover various modifications and equivalent arrangements included within the spirit and scope of the appended claims.

What is claimed is:

1. A convergence yoke for equalizing a deflection field to improve focus characteristics of a cathode ray tube, comprising:

a cylindrical core having an inner circumference;

vertical correcting coils wound symmetrically on a first portion of the inner circumference of said core so that a central axis thereof is substantially perpendicular to a central axis of the core;

horizontal correcting coils wound symmetrically on a second portion of the inner circumference of said core so that a central axis thereof is substantially perpendicular to the central axis of the core, said first portion being a greater distance from the central axis of the core than the second portion; and wherein each of said horizontal and vertical correcting coils extend along an arc with respect to the central axis of the core in the range of 100° to 130°, said horizontal and vertical correcting coils producing a mutually compensating barrel-shaped deflection field and pincushion-shaped deflection field for improving focus characteristics, and a deflection field which changes from substantially the barrel-shaped deflection field to substantially the pincushion-shaped deflection field along an axial direction of the cathode ray tube as a function of a deflection signal for correcting coma aberration.

2. The convergence yoke of claim 1 wherein each of said vertical and horizontal correcting coils are wound symmetrically in a substantially elliptical shape.

3. The convergence yoke of claim 1 wherein each of said vertical and horizontal correcting coils are wound symmetrically in a substantially rectangular shape.

4. A convergence yoke for equalizing a deflection field to improve focus characteristics of a cathode ray tube, comprising:

a cylindrical core having an inner circumference;

vertical correcting coils wound symmetrically on a first part of the inner circumference of said core so that a central axis thereof is substantially perpendicular to a central axis of the core;

horizontal correcting coils wound symmetrically on a second part of the inner circumference of said core so that a central axis thereof is substantially perpendicular to the central axis of the core, said first part being displaced from said second part in a direction substantially parallel to the central axis of the core; and wherein each of said horizontal and vertical correcting coils extend along an arc with respect to the central axis of the core in the range of 100° to 130°, said horizontal and vertical correcting coils producing a mutually compensating barrel-shaped deflection field and pincushion-shaped deflection field for improving focus characteristics, and a deflection field which changes from substantially the barrel-shaped deflection field to substantially the pincushion-shaped deflection field along an axial direction of the cathode ray tube as a function of a deflection signal for correcting coma aberration.

5. The convergence yoke of claim 4 wherein each of said vertical and horizontal correcting coils are wound symmetrically in a substantially elliptical shape.

6. The convergence yoke of claim 4 wherein each of said vertical and horizontal correcting coils are wound symmetrically in a substantially rectangular shape.

* * * * *

UNITED STATES PATENT AND TRADEMARK OFFICE

CERTIFICATE OF CORRECTION

PATENT NO. : 5,719,542

DATED : February 17, 1998

INVENTOR(S) : Jinhong Park; Yoonseok Cha; Doohyun Lee

It is certified that error appears in the above-identified patent and that said Letters Patent is hereby corrected as shown below:

Column 2, line 12, replace "beams is deteriorates" with
-- beams deteriorate --
Column 2, line 57, change "cathod" to -- cathode --.
Column 5, line 9, change "yoke" to -- field --.
Column 5, line 32, after "core" delete the period.
Column 5, line 46, change "yoke" to -- field --.
Column 6, line 30, change "characteristic" to -- characteristics --.

Signed and Sealed this

Tenth Day of August, 1999

*Attest:*

Q. TODD DICKINSON

*Attesting Officer*

*Acting Commissioner of Patents and Trademarks*